US008702171B2

(12) United States Patent
van Hekken

(10) Patent No.: US 8,702,171 B2
(45) Date of Patent: Apr. 22, 2014

(54) ARTICLE OF FURNITURE

(75) Inventor: Hendrik R. van Hekken, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 384 days.

(21) Appl. No.: 13/116,485

(22) Filed: May 26, 2011

(65) Prior Publication Data

US 2011/0304183 A1 Dec. 15, 2011

Related U.S. Application Data

(60) Provisional application No. 61/353,321, filed on Jun. 10, 2010.

(51) Int. Cl.
*A47C 1/033* (2006.01)
*B60N 2/10* (2006.01)

(52) U.S. Cl.
USPC ..... 297/354.1; 297/296

(58) Field of Classification Search
USPC ..... 297/354.1, 354.12, 284.1, 344.19, 297/303.1, 296
See application file for complete search history.

(56) References Cited

U.S. PATENT DOCUMENTS

| | | | | |
|---|---|---|---|---|
| 3,215,468 | A * | 11/1965 | Swenson et al. | 297/284.1 |
| 3,233,885 | A | 2/1966 | Propst | |
| 3,588,172 | A * | 6/1971 | McGregor | 297/362.13 |
| 4,157,203 | A * | 6/1979 | Ambasz | 297/300.5 |
| 4,627,663 | A | 12/1986 | LaPointe | |
| 5,217,276 | A | 6/1993 | LaPointe et al. | |
| 5,649,739 | A | 7/1997 | Zapf | |
| 5,730,494 | A | 3/1998 | LaPointe et al. | |
| 5,887,946 | A | 3/1999 | Raftery | |
| 6,257,664 | B1 * | 7/2001 | Chew et al. | 297/284.9 |
| 6,739,663 | B2 * | 5/2004 | Gevaert | 297/296 |
| 7,425,103 | B2 * | 9/2008 | Perez-Sanchez | 403/121 |
| 7,451,950 | B2 * | 11/2008 | Perez-Sanchez | 244/219 |
| D600,034 | S | 9/2009 | White, III et al. | |
| D622,517 | S | 8/2010 | Tozier | |
| D625,117 | S | 10/2010 | Houriet | |
| 8,282,166 | B2 * | 10/2012 | Piretti | 297/294 |
| 2009/0051201 | A1 | 2/2009 | Wiecek | |
| 2010/0072799 | A1 | 3/2010 | Peterson et al. | |

FOREIGN PATENT DOCUMENTS

| | | | |
|---|---|---|---|
| DE | 102 51 365 | | 5/2004 |
| DE | 10251365 | A1 | 5/2004 |
| WO | 01/76418 | A1 | 10/2001 |
| WO | 0176418 | | 10/2001 |
| WO | WO 2008/041868 | * | 4/2008 |

OTHER PUBLICATIONS

International Preliminary Report on Patentability for PCT/US2011/038342 dated Dec. 10, 2012.
PCT/US2011/038342 International Search Report and Written Opinion of the International Searching Authority, dated Oct. 12, 2011 (12 pages).

* cited by examiner

*Primary Examiner* — David R Dunn
*Assistant Examiner* — Timothy J Brindley
(74) *Attorney, Agent, or Firm* — Buchanan Ingersoll & Rooney PC

(57) ABSTRACT

An article of furniture includes a base, a seat frame supported by the base, and a back frame attached to the seat frame. The back frame includes an upper portion and a lower portion. The upper portion is connected to the lower portion by at least one first elastomeric member such that the upper portion is moveable relative to the lower portion. The upper portion is moveable from an upright position to at least one reclined position. In some embodiments of the article of furniture, the at least one first elastomeric member is a strap composed of a polymeric material, such as, for example, a thermoplastic polyester elastomer or a polymeric material containing at least one elastomer. In some embodiments, the article of furniture may be designed as a chair, a lounge chair, or an office chair.

16 Claims, 22 Drawing Sheets

ARTICLE OF FURNITURE

CROSS REFERENCE TO RELATED APPLICATION

The present application claims priority to U.S. Provisional Patent Application Ser. No. 61/353,321, which was filed on Jun. 10, 2010. The entirety of U.S. Provisional Patent Application Ser. No. 61/353,321 is incorporated by reference herein.

FIELD OF THE INVENTION

The present invention relates to furniture such as chairs.

BACKGROUND OF THE INVENTION

Lounge chairs are often used in residential and business environments. Such chairs are often designed to provide a desired aesthetic effect while also allowing a person to sit in the chair and comfortably lean against the back of the chair.

In many designs for lounge chairs, the back of the chair is affixed so that it does not move. Thus, a user cannot move the back of the chair rearward to a reclined or tilted position to support the user's back if the user wishes to sit in a substantially reclined position. Examples of such a lounge chair may be appreciated from U.S. Pat. Nos. D625,117, D622,517, and D600,034.

Other designs for lounge chairs permit a back of the chair to recline and also permit a foot stool to extend from the base of the chair to support a user that is fully reclined or substantially reclined. Such chairs may be referred to as recliners and often utilize metal linkage systems that are actuated by the user moving a handle or pushing the back of the chair rearwardly. Examples of such lounge chairs may be appreciated from U.S. Pat. Nos. 5,730,494, 5,217,276, and 4,627,663 and U.S. Patent Application Publication No. US 2009/0051201.

The linkage systems used in recliners can be expensive to manufacture. Further, such systems tend to be bulky and reduce the design options for providing a chair that may have a desirable aesthetic effect. In contrast, a chair that does not permit a chair back to be reclined, while often less expensive to make, usually provides less comfort to a user that wishes to sit in a substantially reclined position.

A new chair design is needed that may permit a user to recline the back of a chair so that a user may be comfortable in a number of different sitting positions while seated in the chair. Preferably, such a chair does not have to utilize a system that requires expensive linkage systems or other expensive recline systems to recline a chair back or maintain the position of the reclined chair back while also expanding the viable design options for such a chair.

SUMMARY OF THE INVENTION

An article of furniture includes a base, a seat frame supported by the base, and a back frame attached to the seat frame. The back frame includes an upper portion and a lower portion. The upper portion is connected to the lower portion by one or more first elastomeric members so that the upper portion is moveable relative to the lower portion. The upper portion is moveable from an upright position to at least one reclined position.

Embodiments of the article of furniture may include a lounge chair, an office chair, a love seat, or other seating unit. Preferably, embodiments of the article of furniture do not utilize any linkage system for controlling the recline of the upper portion of the back frame nor any locking mechanism that utilizes an element to positively or mechanically hold the back frame in a particular reclined position. That being said, it is contemplated that some less preferred embodiments of the article of furniture could include such a linkage system or such a locking mechanism.

The one or more first elastomeric members are configured so that the upper portion of the back frame is moveable to a reclined position upon a first force acting on the upper portion of the back frame to move the upper portion and is also configured to maintain that position after the first force is removed until a second force is applied to the upper portion of the back frame to move the upper portion to a different position, such as the upright position. Preferably, the first elastomeric member is configured to be flexed into a flexed position when the upper portion is moved to a reclined position and stay in the flexed position to maintain the upper portion of the back frame in that position.

In some embodiments, the upper portion of the back frame may include a plurality of back support elements. Each back support element may be interconnected to at least one other back support element by at least one second elastomeric member. Preferably, each back support element is composed of a polymeric material, such as plastic or an elastomeric material. The back support elements may preferably be polygonal shaped, such as rectangular, hexagonal, or triangular shaped elements. The second elastomeric members may include one or more second elastomeric members positioned on the front surface of the back frame and a plurality of members positioned on the rear surface of the back frame.

It should be understood that upholstery, padding, a liner or a covering may be attached to the back frame and seat frame. The liner or covering may be any of a number of suitable materials Likewise, the padding that is utilized may be any of a number of padding options, such as foam or cushions, to provide a desired seating comfort profile and aesthetic effect to the article of furniture.

In other embodiments, the article of furniture may include a base, a seat frame attached to the base, and a back frame. The upper portion of the back frame may be attached to the lower portion of the back frame by one or more first elongated elastomeric members. The lower portion of the back frame may be attached to the seat frame. The upper portion of the back frame may include a number of back support elements. Each back support element may be connected to at least one other back support element by at least one second elastomeric member. The upper portion of the back frame is configured to move from an upright position to a reclined position. The one or more first elongated elastomeric members are configured to flex when the upper portion is moved to the reclined position. The at least one first elastomeric member is also attached to the upper back frame portion such that the at least one first elastomeric member does not bias the upper portion of the back frame to the upright position after the upper portion of the back frame has been moved to the reclined position.

Preferably, the lower portion of the back frame is integrally attached to the seat frame or is attached to the seat frame such that the lower portion does not move relative to the seat frame.

In some embodiments, the one or more first elastomeric member may include a plurality of elastomeric straps that extend from respective back support elements of the upper portion of the back frame to a portion of the lower portion of the back frame. These elastomeric straps may be positioned on the rear surface of the back frame. These straps may be positioned so that their lengths extend in a direction that is transverse to one or more other elastomeric straps.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of an article of furniture are shown in the accompanying drawings and certain present preferred methods of practicing the same are also illustrated therein.

DETAILED DESCRIPTION OF PRESENT PREFERRED EMBODIMENTS

Figure 1:
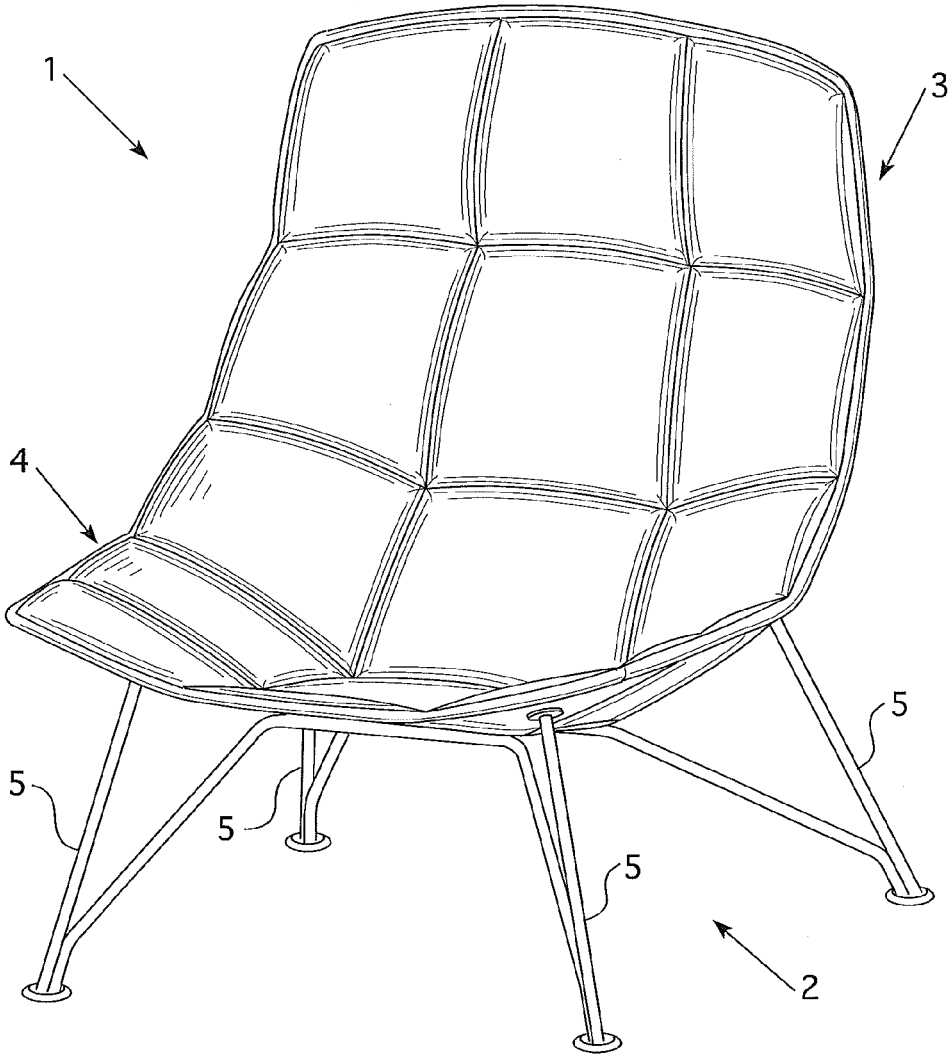
FIG. 1 is a perspective view of a first present preferred embodiment of a lounge chair.

Referring to FIGS. 1-4, a lounge chair 1 may include a base 2 that supports a seat 4 and a back 3. The base 2 may include a plurality of legs 5 that are attached to the seat 4. The back 3 of the lounge chair includes a lower portion 7 near the seat 4, an upper portion 9 and a middle portion 8 between the upper portion 9 and lower portion 7. The upper portion 9 of the back is configured to be flexed backwards, or reclined, as may be appreciated from FIGS. 2 and 3.

Figure 4:
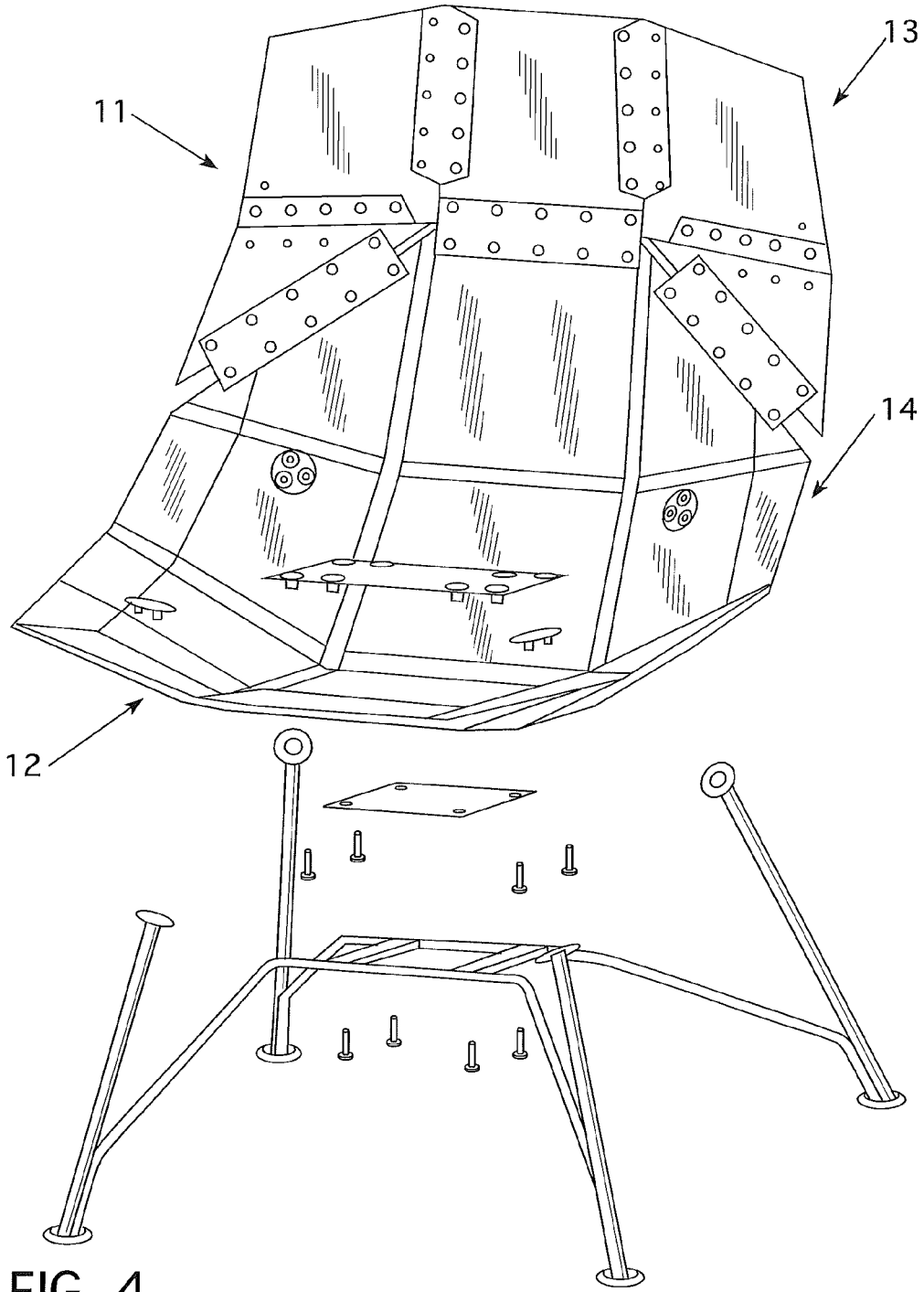
FIG. 4 is an exploded view of the first present preferred embodiment of the lounge chair. However, upholstery that may be attached to the seat or back of the chair is not shown.

The back 3 of the lounge chair includes a back frame 11, as may be appreciated from FIG. 4. The seat 4 of the chair includes a seat frame 12. The seat frame 12 and back frame 11 are connected to each other. The seat frame 12 and back frame 11 are preferably upholstered in a finalized chair configuration for selling a chair to a consumer such as a homeowner or interior designer. For example, foam may be positioned adjacent to the seat frame 12 and back frame 11 and the seat frame and back frame may covered by a fabric, leather, or other material. Of course, other upholstery options may also be used to upholster the back fame and seat frame of the chair 1.

Preferably, the back frame is composed of two portions. A first portion 13 is a frame for the upper portion 9 of the back. A second portion 14 is a frame for the middle and lower portion of the back. The second portion 14 of the back frame is preferably integrally molded with the seat frame 12 to form a seating shell.

Figure 5:
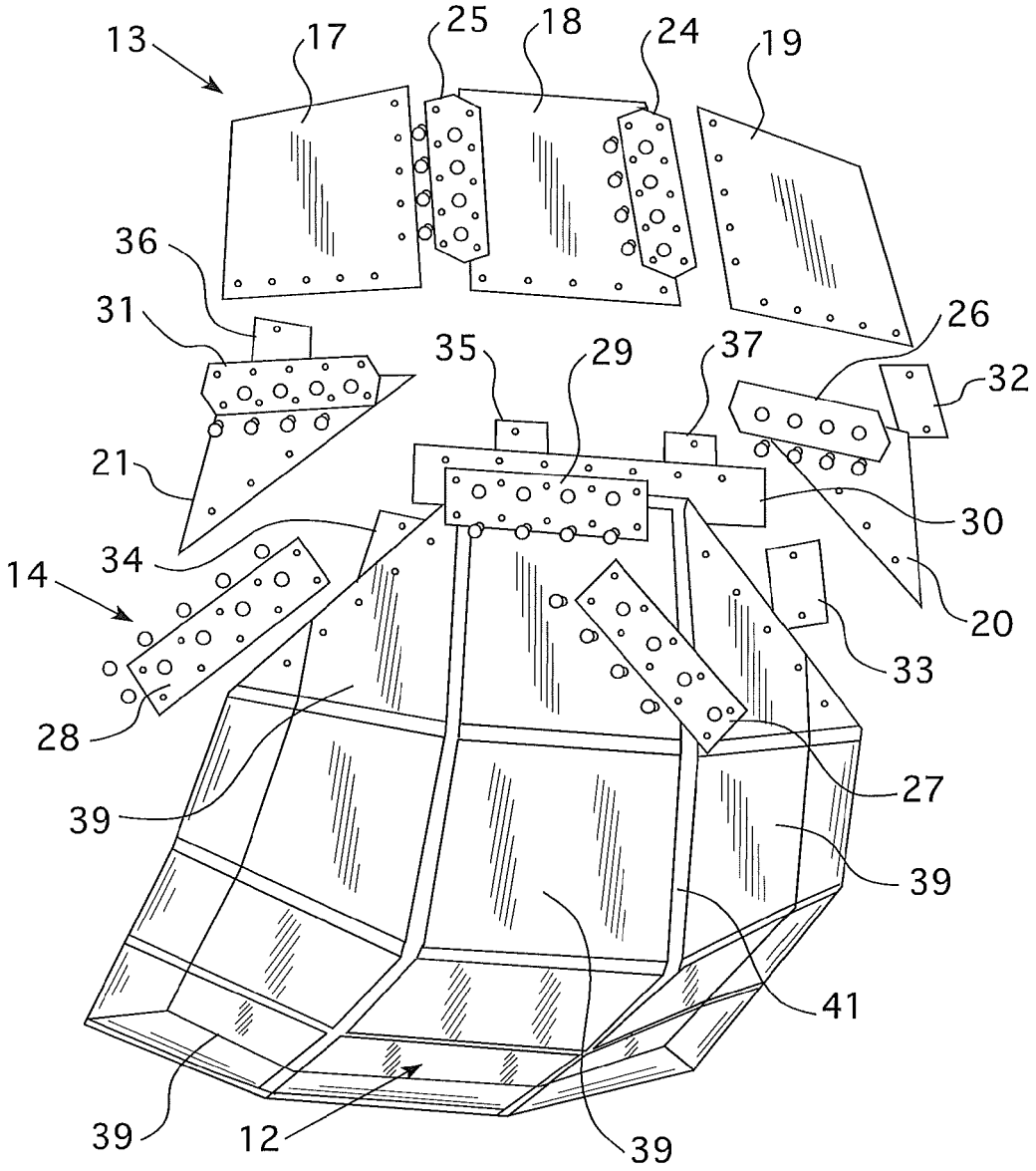
FIG. 5 is an exploded view of the back frame and seat frame of the first present preferred embodiment of the lounge chair.
Figure 6:
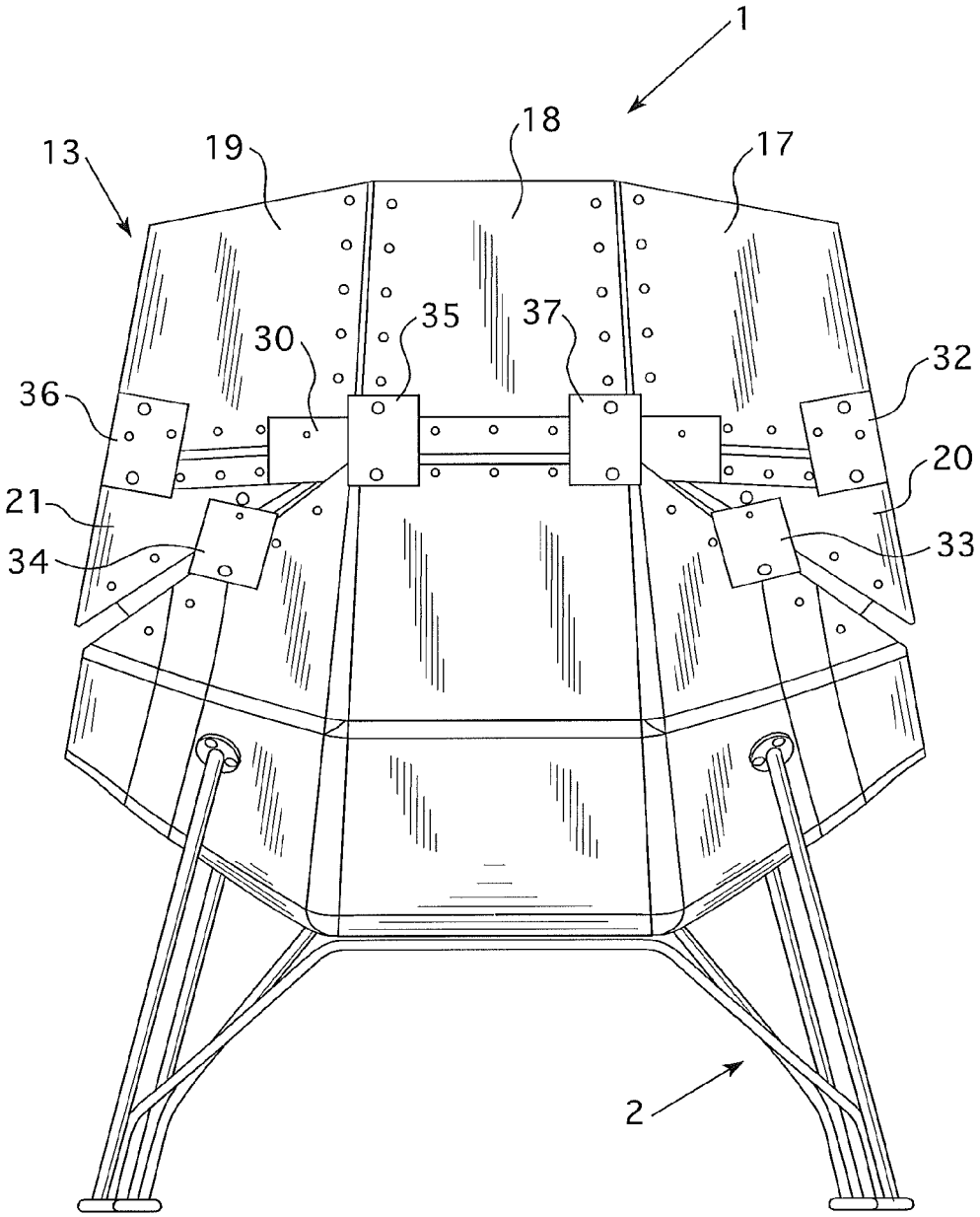
FIG. 6 is a rear view of the first present preferred embodiment of the lounge chair with the upholstery that may be attached to the back and seat frames removed.
Figure 7:
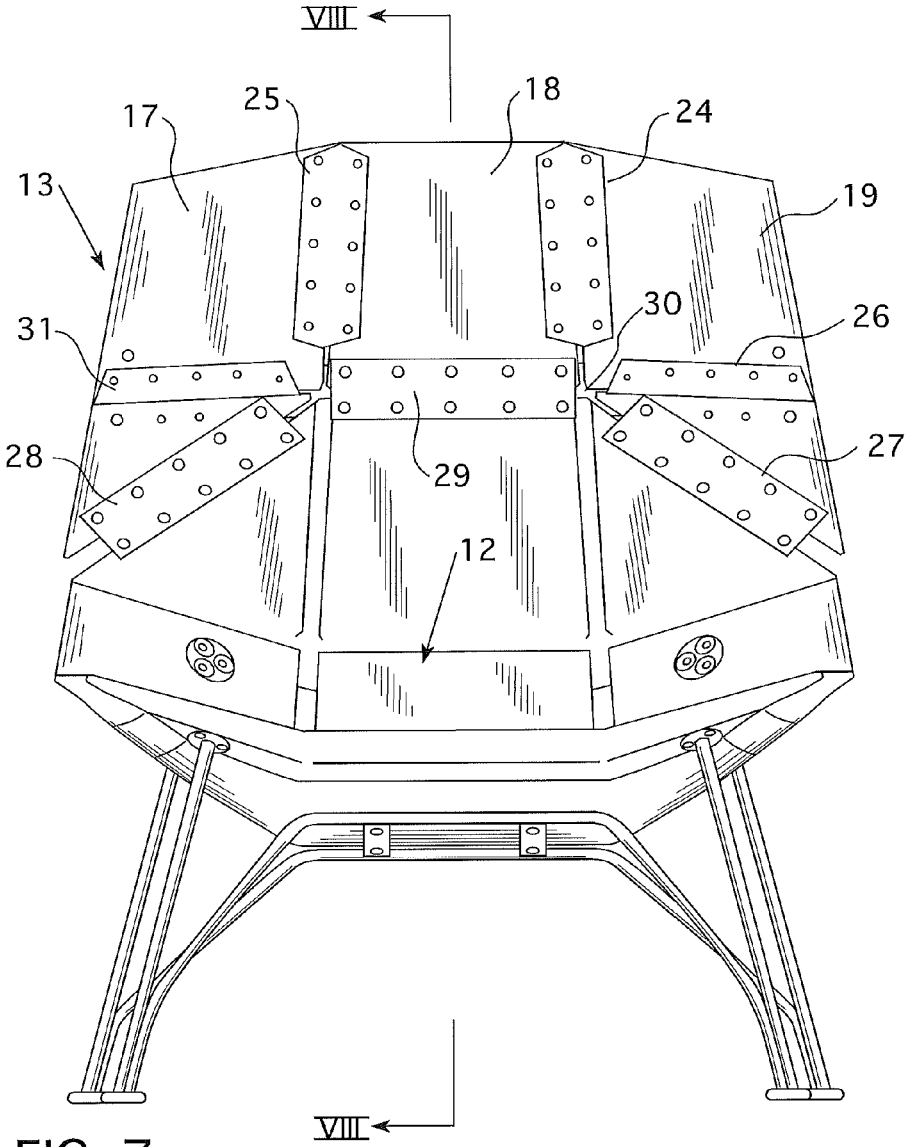
FIG. 7 is a front view of the first present preferred embodiment of the lounge chair with the upholstery that may be attached to the back and seat frames removed.
Figure 8:
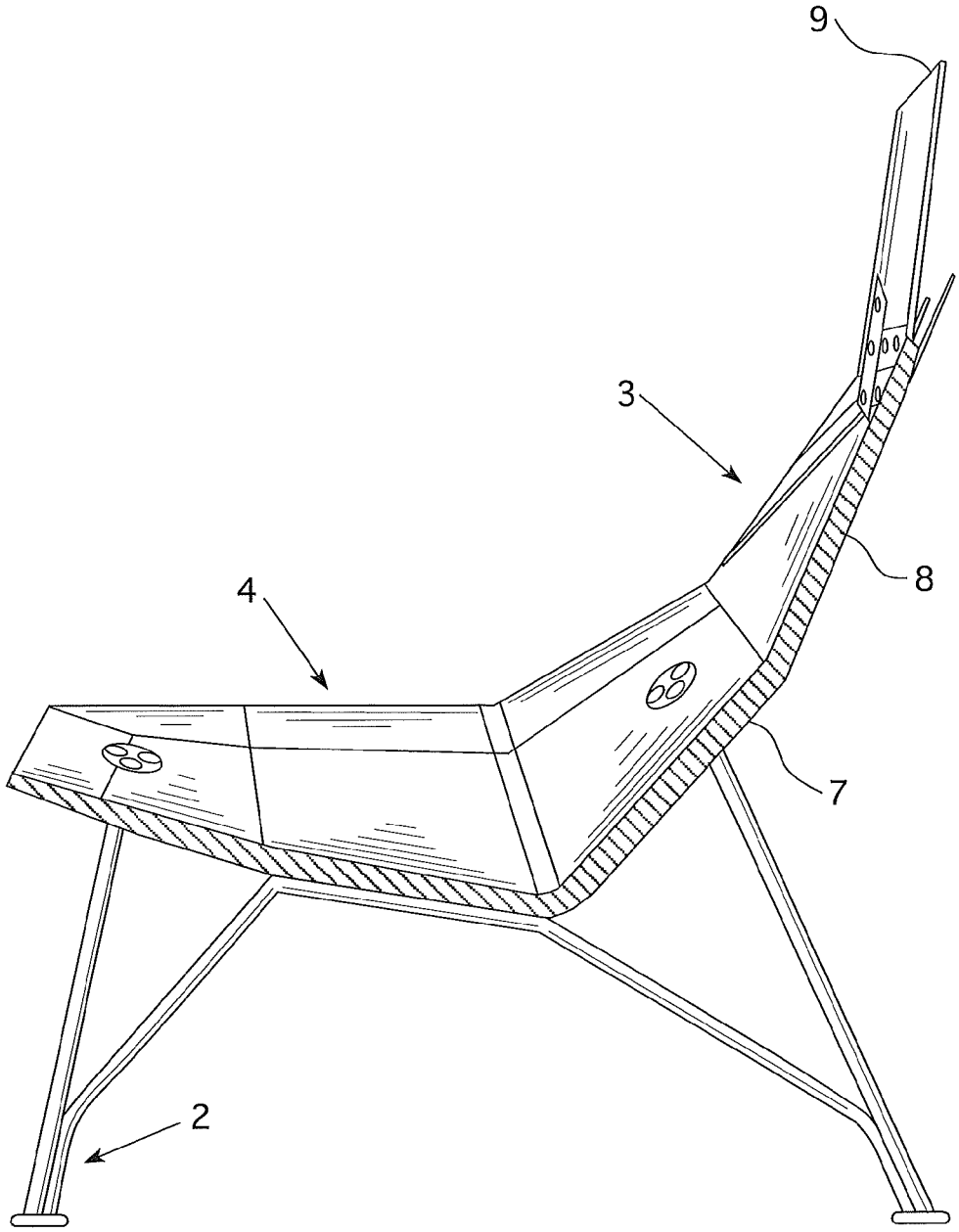
FIG. 8 is a cross sectional view of the back and seat frames of the first present preferred embodiment of the lounge chair taken along line VIII-VIII in FIG. 7.
Figure 9:
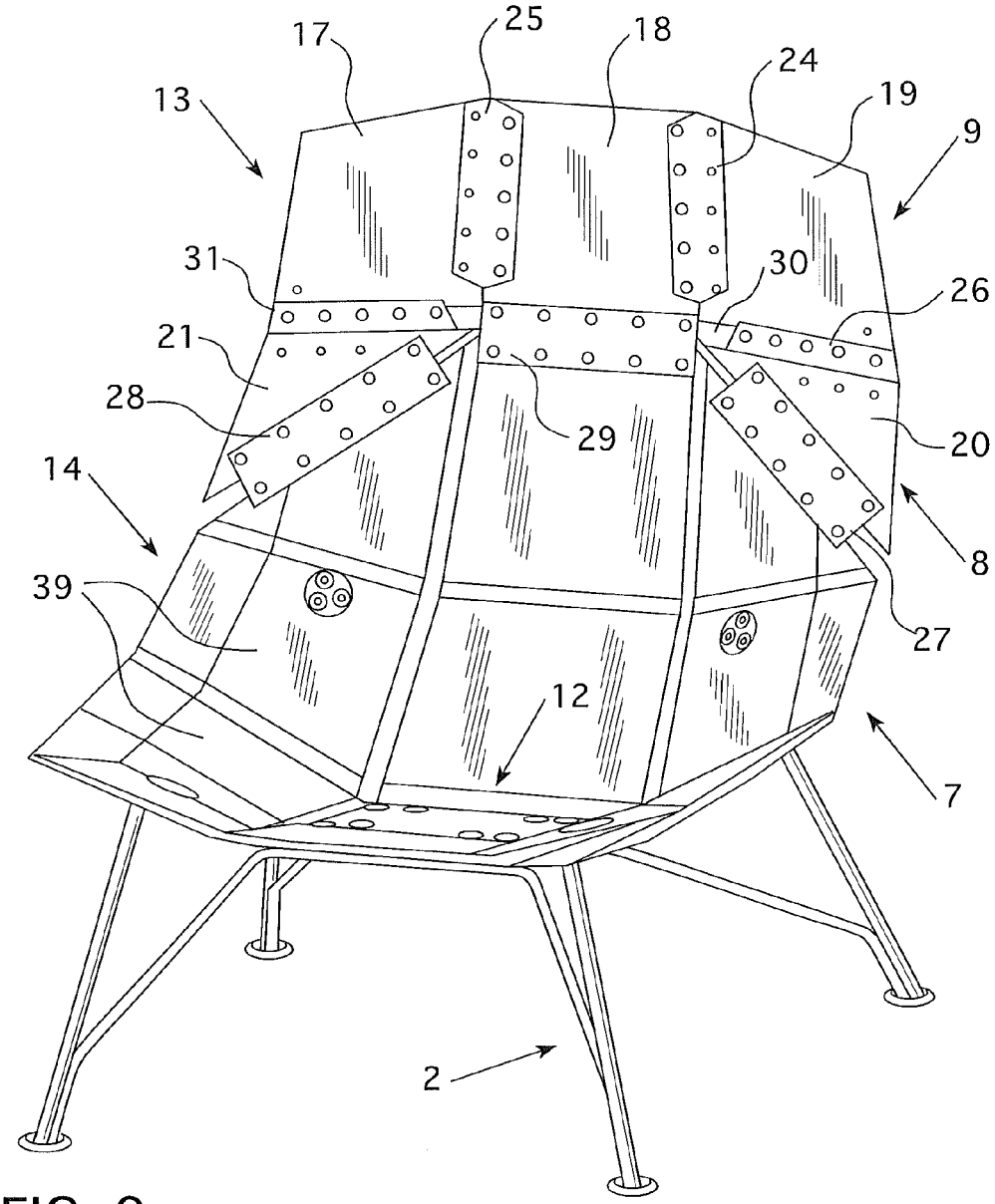
FIG. 9 is a perspective view of the first present preferred embodiment of the lounge chair with the upholstery that may be attached to the back and seat frames removed.
Figure 10:
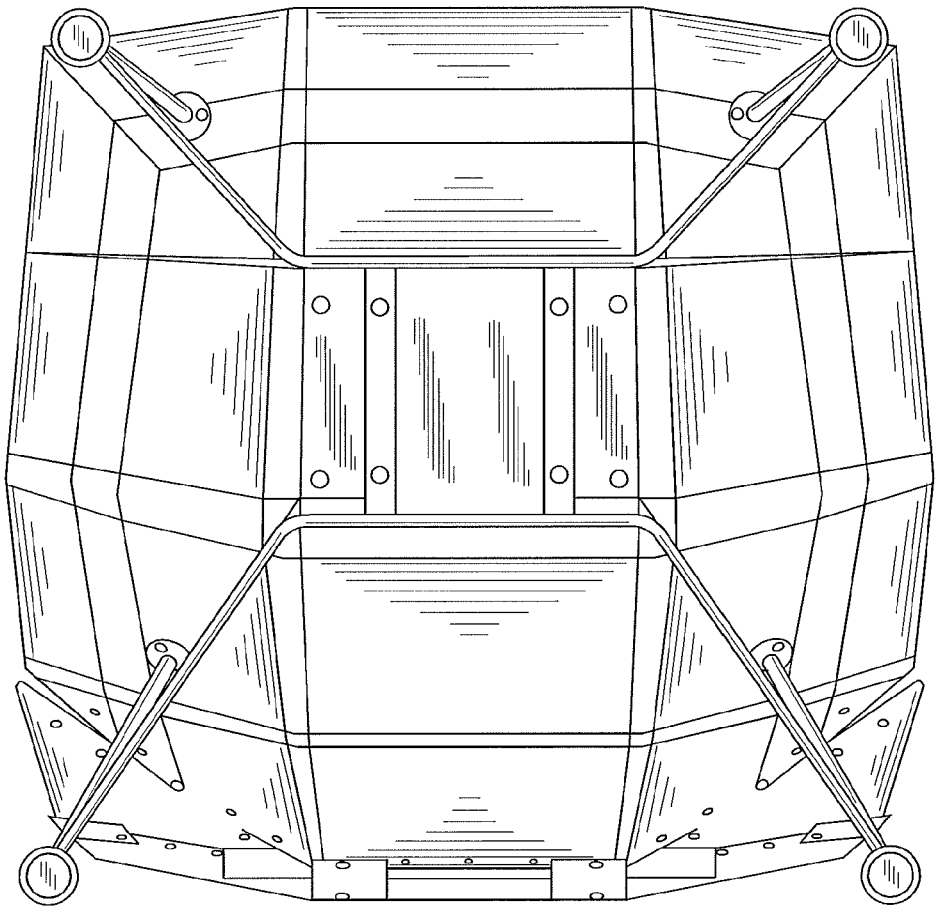
FIG. 10 is a bottom view of first present preferred embodiment of the lounge chair with the upholstery that may be attached to the back and seat frames removed.
Figure 11:
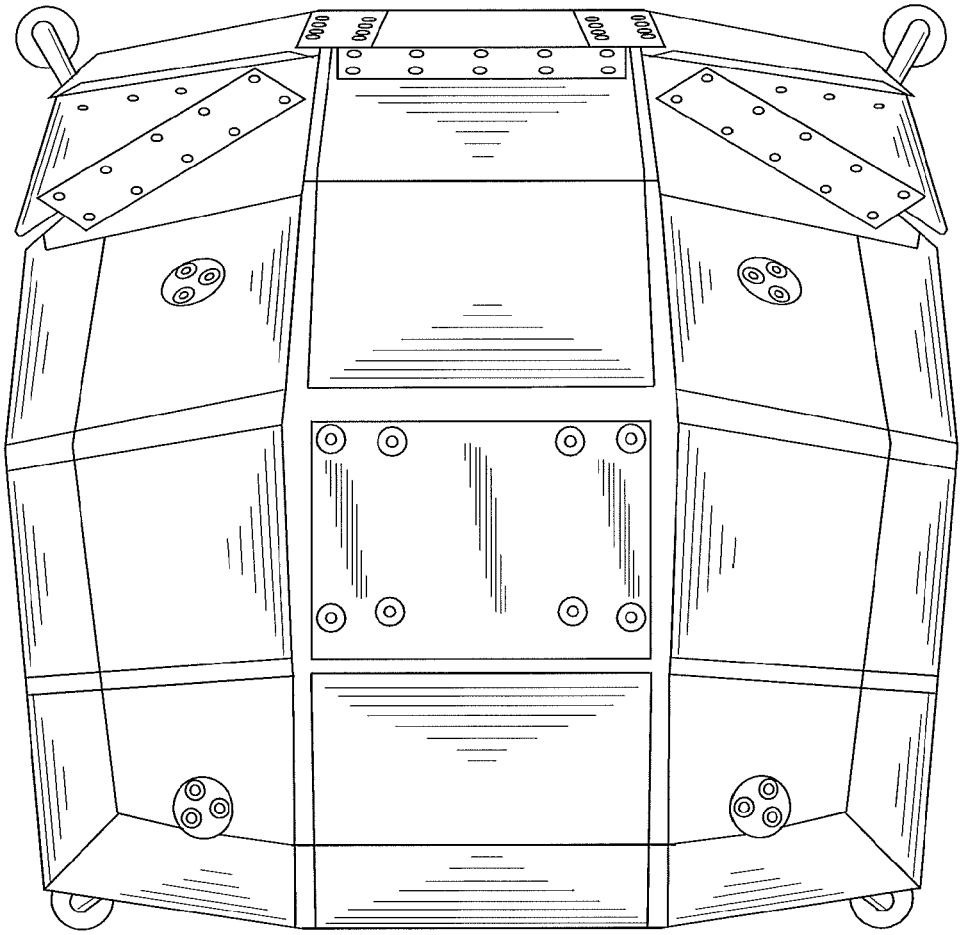
FIG. 11 is a top view of the first present preferred embodiment of the lounge chair with upholstery that may be attached to the back and seat frames removed.
Figure 12:
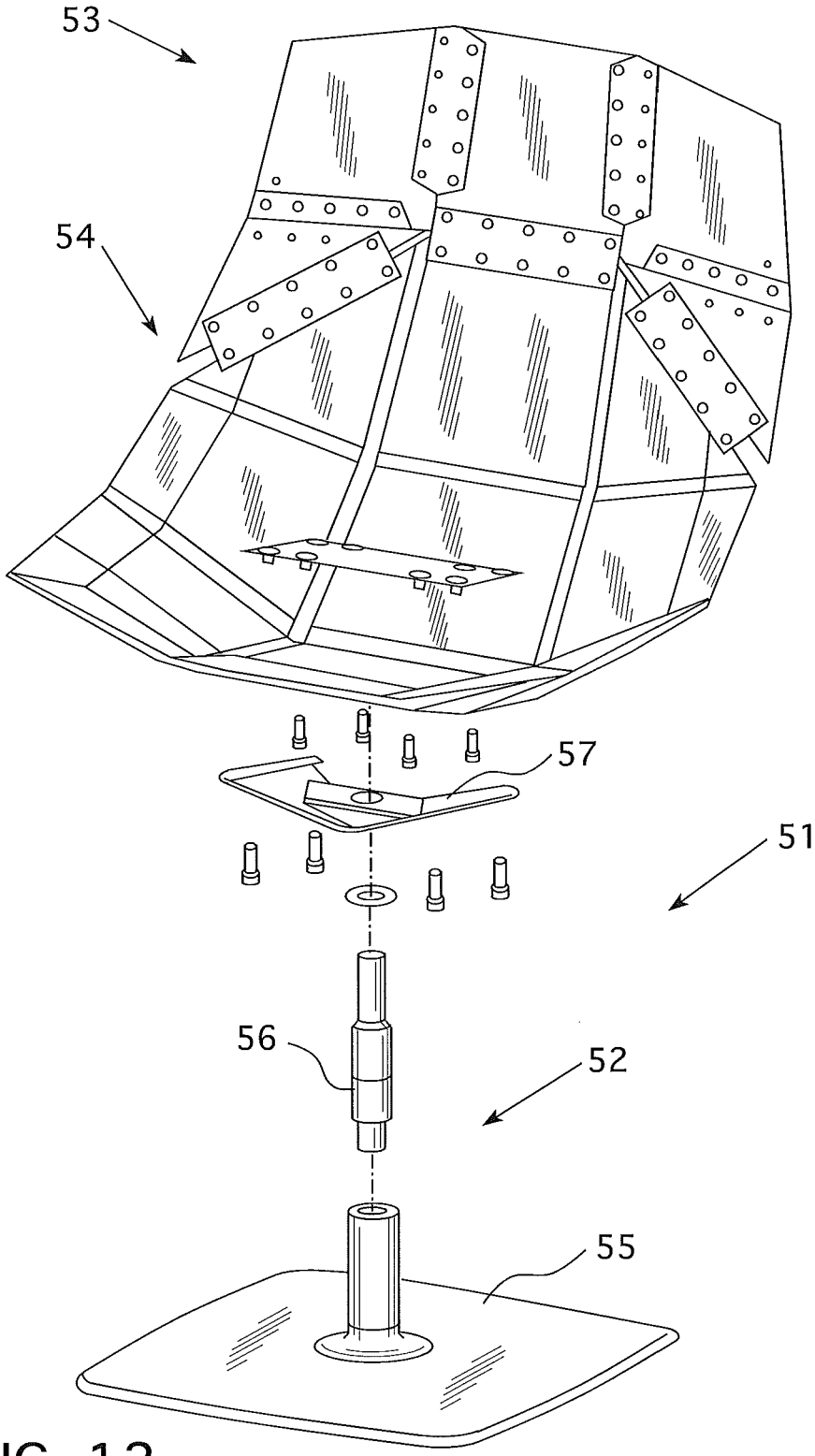
FIG. 12 is an exploded view of a second present preferred embodiment of a chair with upholstery that may be attached to the back and seat frames removed.
Figure 13:
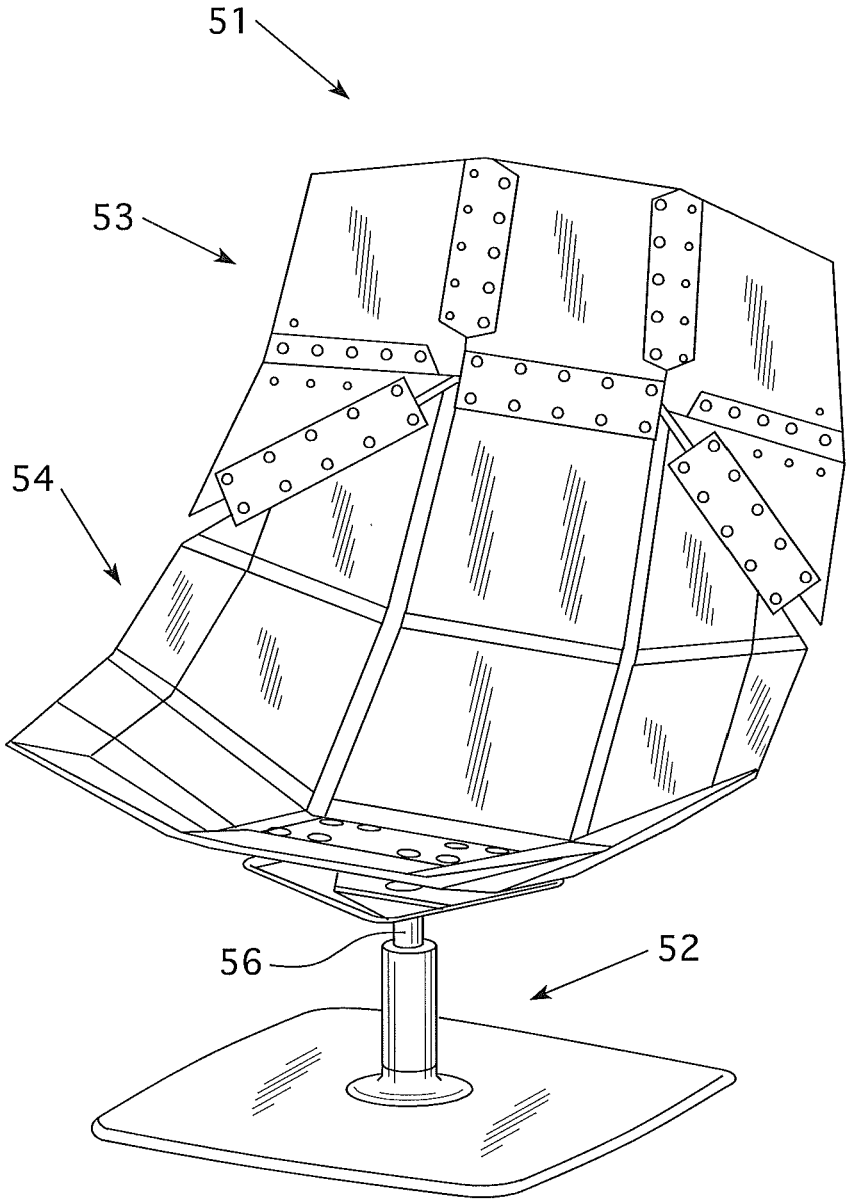
FIG. 13 is a perspective view of the second present preferred embodiment of the chair with upholstery that may be attached to the back and seat frames removed.
Figure 14:
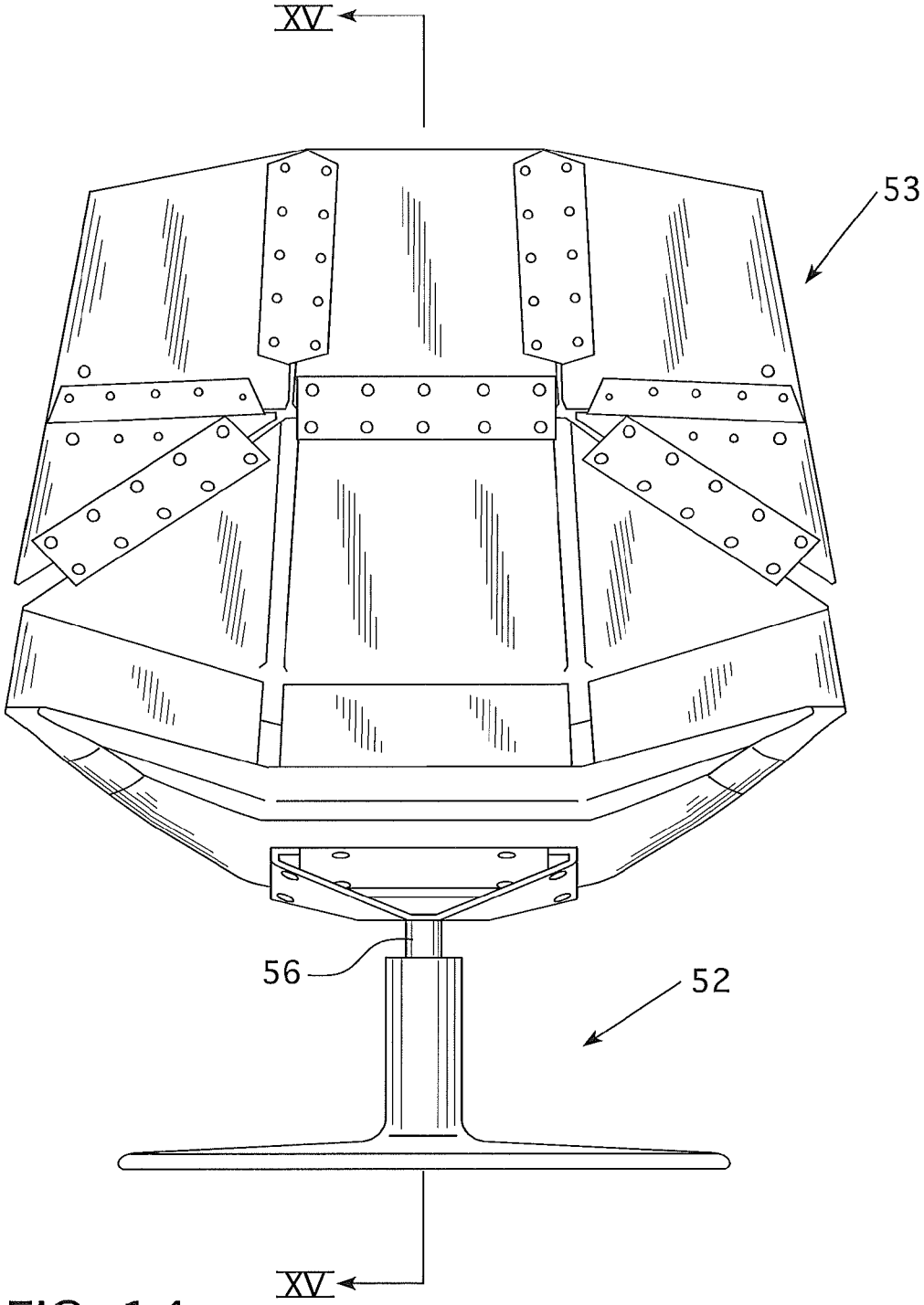
FIG. 14 is a front view of the second present preferred embodiment of the chair with upholstery that may be attached to the back and seat frames removed.
Figure 15:
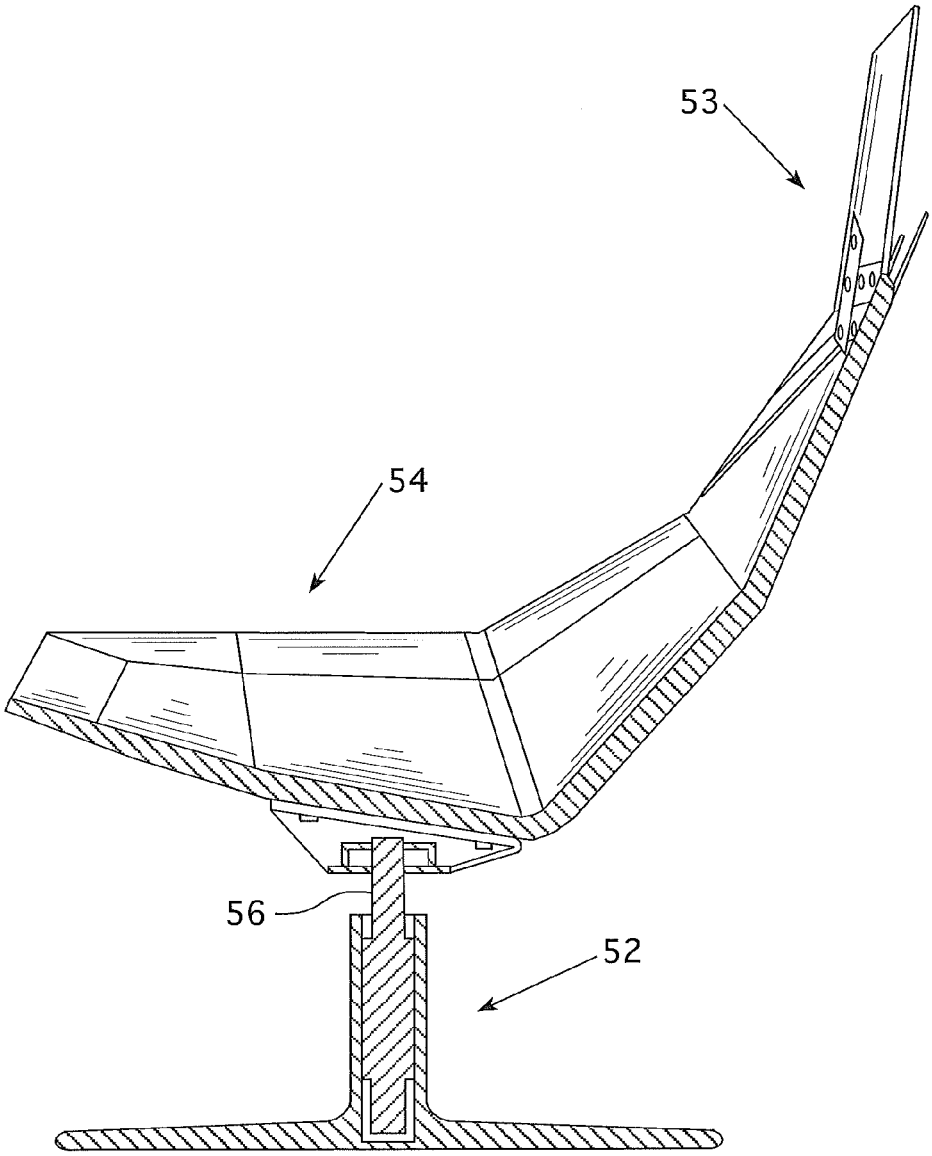
FIG. 15 is a cross sectional view of the second present preferred embodiment of the chair with upholstery that may be attached to the back and seat frames removed taken along line XV-XV in FIG. 14.
Figure 16:
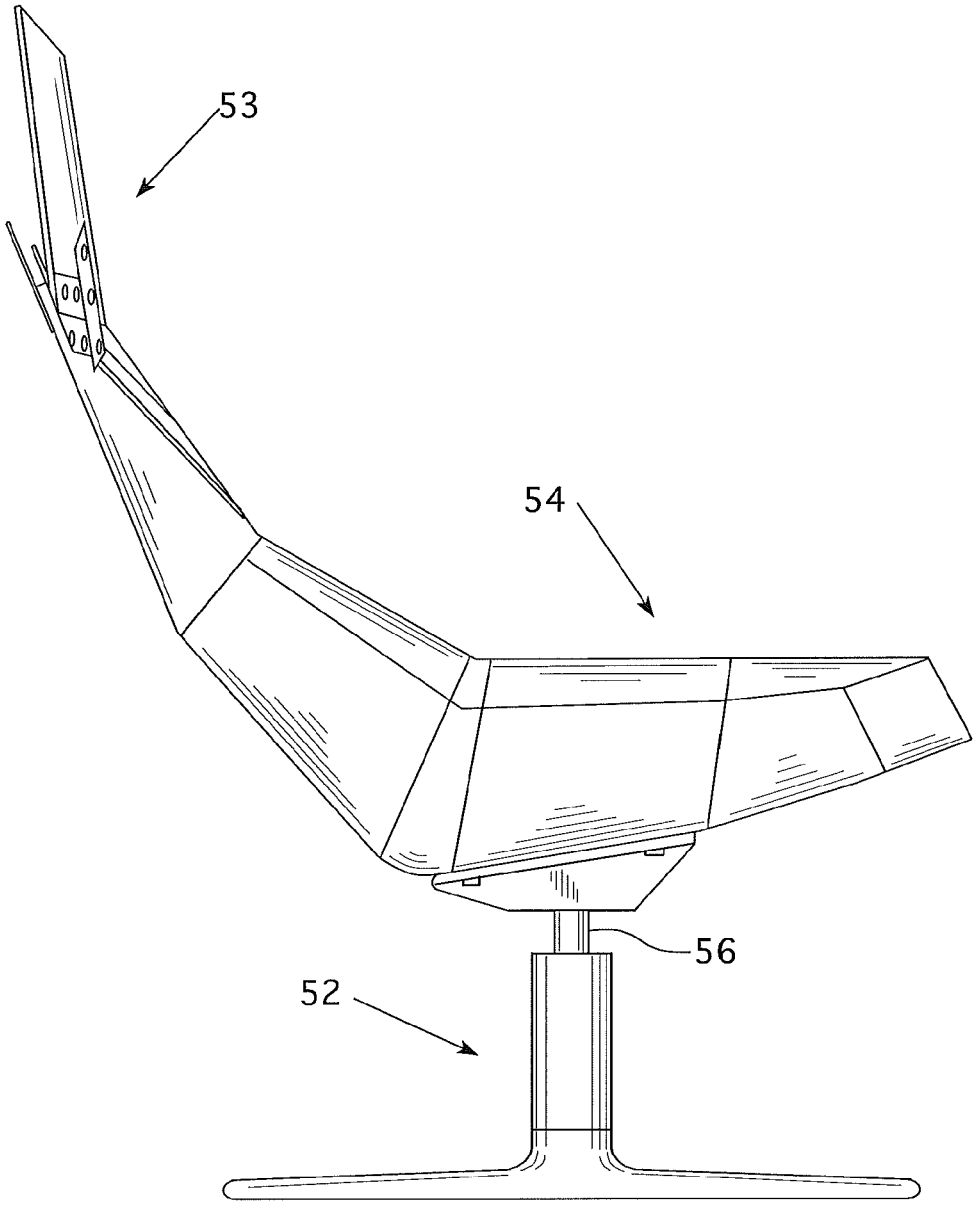
FIG. 16 is a side view of the second present preferred embodiment of the chair with upholstery that may be attached to the back and seat frames removed.
Figure 17:
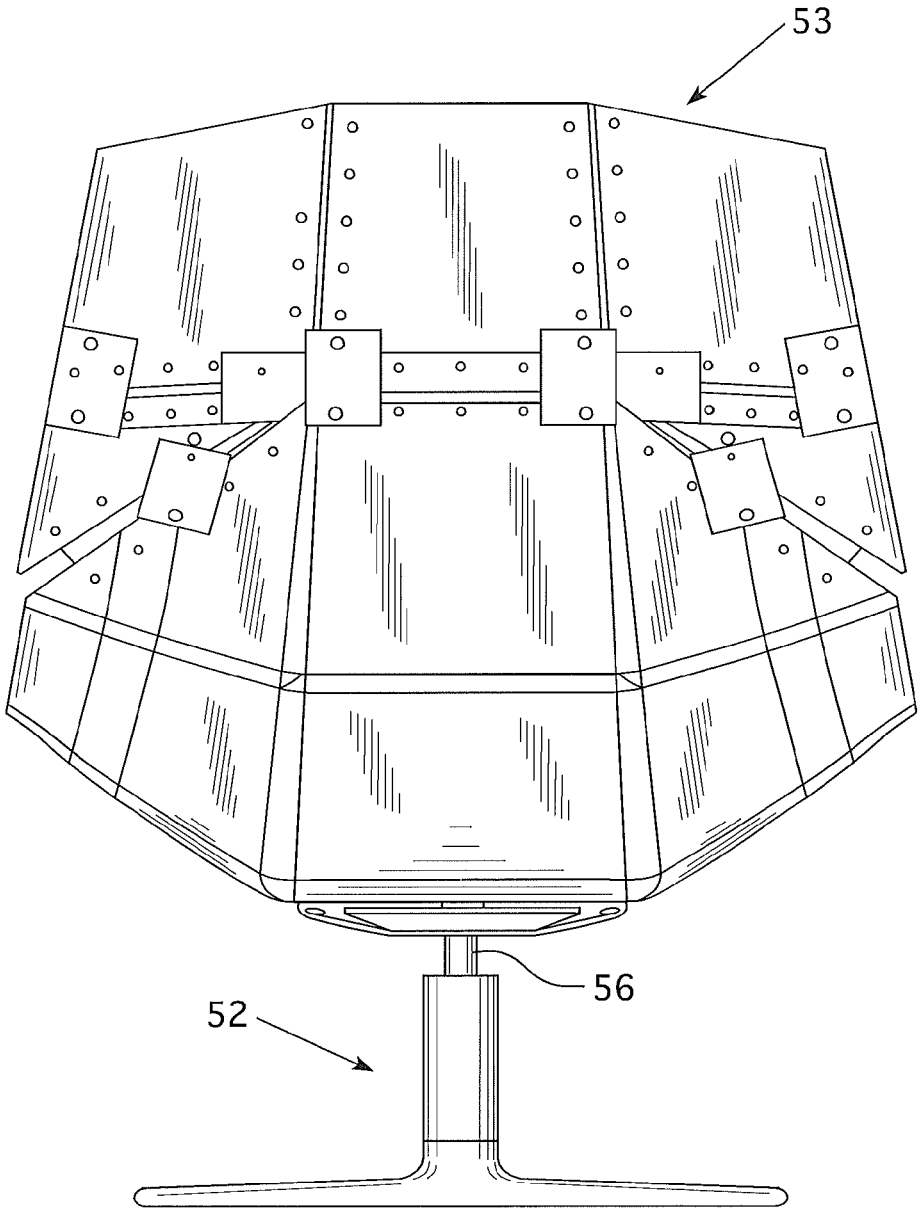
FIG. 17 is a back view of the second present preferred embodiment of the chair with upholstery that may be attached to the back and seat frames removed.
Figure 18:
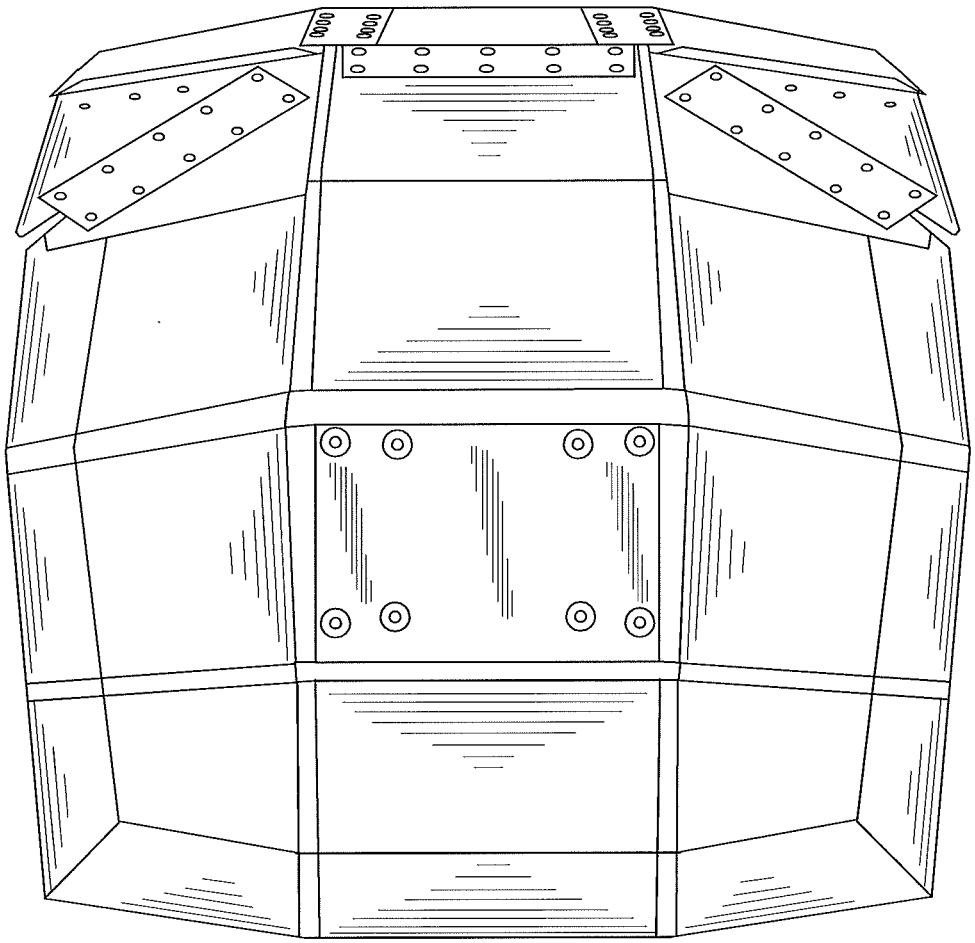
FIG. 18 is a top view of the second present preferred embodiment of the chair with upholstery that may be attached to the back and seat frames removed.
Figure 19:
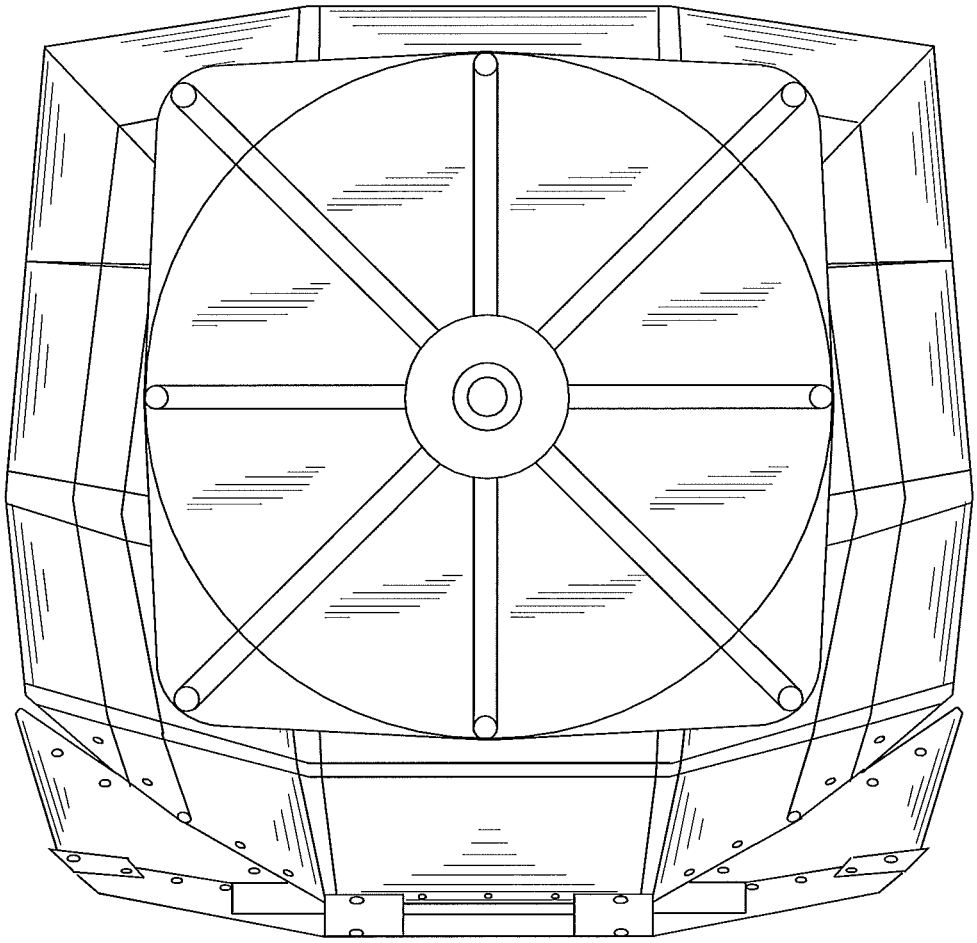
FIG. 19 is a bottom view of the second present preferred embodiment of the chair with upholstery that may be attached to the back and seat frames removed.

Referring to FIG. 5, the first portion 13 of the back frame 11 includes a plurality of plastic frame elements 17, 18 and 19. The frame elements 17, 18 and 19 are sized and configured to provide a desired comfort level and support level to a seated user. Preferably, the frame elements are rectangular or square in shape and composed of plastic or a polymeric material. It is contemplated that the elements 17, 18 and 19 may alternatively have polygonal shapes or irregular shapes or be composed of metal, a thermoplastic polymeric material, a thermoset polymeric material, or other material.

The first portion 13 of the back frame also includes two triangular elements 21 and 20 that are sized and configured to interconnected to a respective upper back element. For example, triangular element 21 is configured to connect to upper back element 17 and triangular element 20 is sized and configured to connect to upper element 19. Back frame elements 20 and 21 may be composed of plastic or a polymeric material such as a thermoset polymeric material, a thermoplastic polymeric material, metal or other material. It is contemplated that elements 20 and 21 may have different shapes or may be integral with a respective back element for a back frame of a different size or configuration.

Preferably, back frame elements 17, 18, 19, 20 and 21 are composed of polypropylene.

The second portion of the back frame 14 is comprised of a plurality of back elements that are integrally molded together and is also integrally molded with the seat frame 12. Each element 39 of the second portion of the back frame and seat frame is separated by interconnecting grooves 41 or channels that are sized and configured to impart a desired level of support and flexibility to the frame for supporting a seated user. Preferably, the seat frame 12 and second portion 14 of the back frame are integrally molded of plastic or a polymeric material to form a seating shell.

Of course, the seat frame 12 and second portion of the back frame 14 may alternatively be molded from metal or may be fabricated by interconnecting numerous different back frame and seat frame elements that are composed of polymeric material, metal, or other material. For example, the seat frame 12 and second portion of the back frame 14 may be integrally molded of a polymeric material such as a structural RIM material, a structural rigid integral skin polyurethane foam or a polyurethane RIM material, a polyisocyanurate RIM material, polyester RIM material, nylon 6 injection molded material, polyepoxide RIM material, or a polyurea RIM material. Preferably, the composition or structure of the seat frame 12 and second portion of the back frame 14 are rigid or are at least less flexible, or more rigid, than the first portion 13 of the back frame. It should be appreciated that the material selected for the back frame elements in the second portion of the back frame and the seat frame may be chosen to provide the back frame with a desired level of support and comfort to a seated user.

The different elements of the first portion 13 of the back frame are interconnected to each other by a plurality of elastomeric straps 24, 25, 26, 27, 28, 29, 30, 31, 32, 33, 34, 35, 36 and 37. Preferably, the elastomeric straps are generally rectangular or polygonal in shape. The elastomeric straps are preferably composed of a thermoplastic polyester elastomer such as Hytrel® material sold by E. I. du Pont de Nemours and Company or its affiliates, such as DuPont. For example, the elastomeric straps may be composed of Hytrel® grade 4456 material. Of course, the elastomeric straps may alternatively be composed of other elastomeric materials or may each be composed of different elastomeric materials to provide a desired support or design characteristic or to help achieve a particular design goal.

A first elastomeric strap 24 may be connected adjacent to elements 19 and 18 or between back frame elements 19 and 18. A second elastomeric strap 25 may be connected between back elements 17 and 18. A third elastomeric 26 strap may be connected between back elements 19 and 20. A fourth elastomeric strap 27 is connected between or adjacent to back element 20 and the second portion 14 of the back frame. A fifth elastomeric strap 28 is connected between or adjacent to back element 21 and the second portion 14 of the back frame. A sixth elastomeric element 31 is connected between the back element 17 and the back element 21. A seventh back element 29 is connected between the back element 18 and the second portion 14 of the back frame between the back element 20 and back element 21 and elastomeric straps 27 and 28. The first, second, third, fourth, fifth, sixth, and seventh elastomeric straps are all positioned on the front surface of back frame 11.

An eighth elastomeric strap 32 is connected between back element 19 and back element 20. A ninth elastomeric strap 33 is connected between the back element 20 and the second portion 14 of the back frame. A tenth elastomeric strap 37 is connected to the second portion 14 of the back frame and back element 18. An eleventh elastomeric strap 34 is connected to the back element 21 and the second portion of the back frame 14. A twelfth elastomeric strap 36 is connected between back element 17 and back element 21. A thirteenth elastomeric strap 35 is connected to back element 18 and the second portion 14 of the back frame. A fourteenth elastomeric strap 30 is connected to back elements 17, 18, 19, 20 and 21 and the second portion 14 of the back frame. The fourteenth elastomeric strap is positioned between the tenth elastomeric strap 37 and the thirteenth elastomeric strap 35 and the rear surface of back elements 17, 18 and 19. The eighth, ninth, tenth, eleventh, twelfth, thirteenth and fourteenth elastomeric straps are all positioned along the rear surface of the back frame 11.

Figure 2:
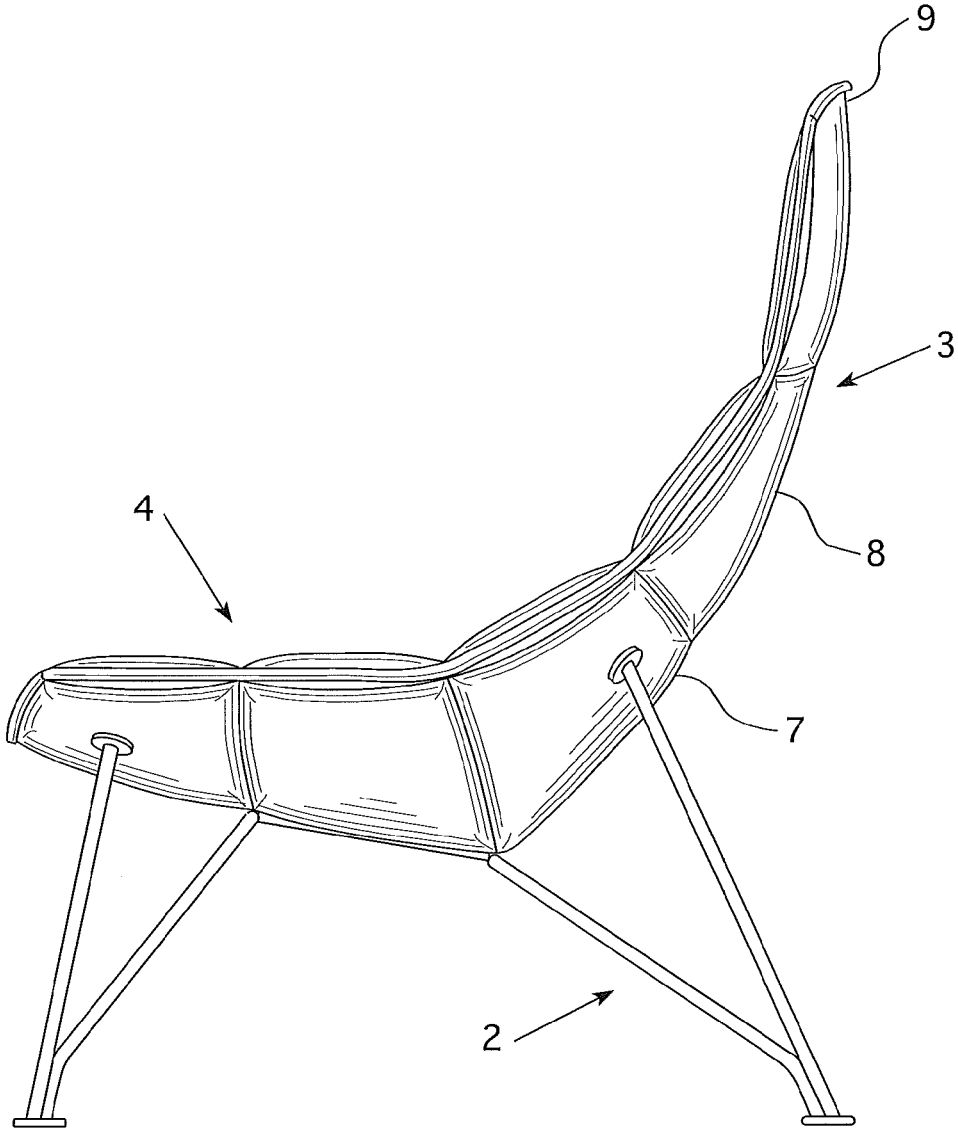
FIG. 2 is a side view of the first present preferred embodiment of the lounge chair illustrating the back of the chair in an upright position.
Figure 3:
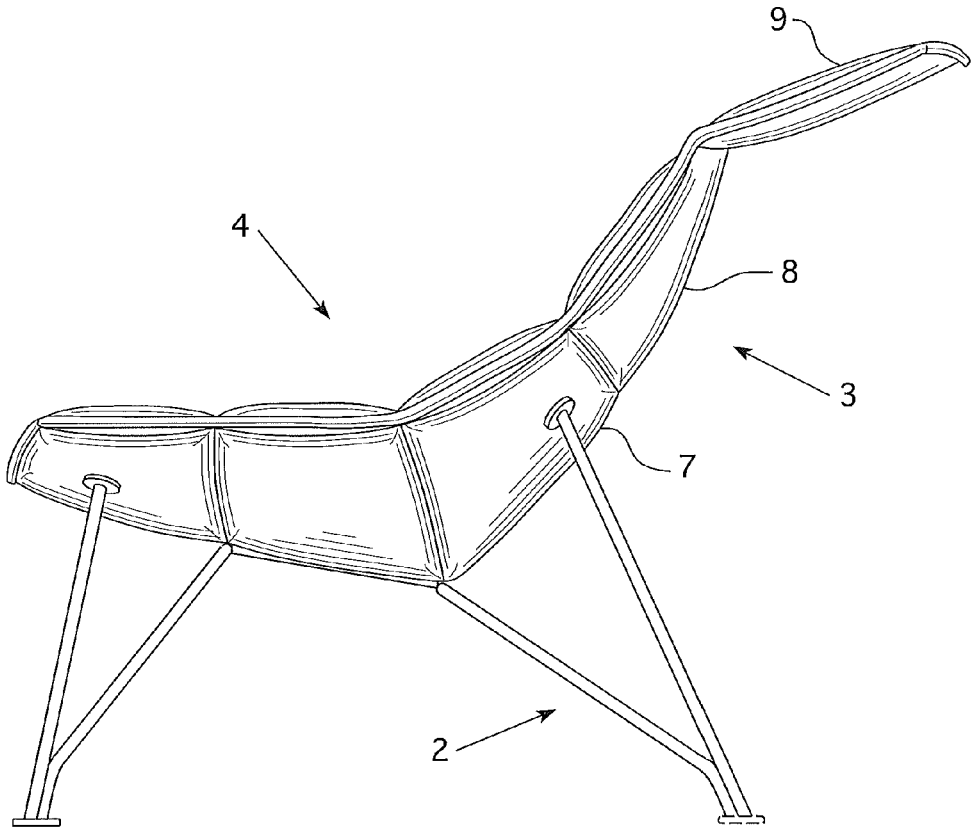
FIG. 3 is a side view of the first present preferred embodiment of the lounge chair illustrating the upper portion of the back of the chair in a reclined position.

The elastomeric straps are sized and configured and attached to respective portions of the back frame elements to permit the back frame to be flexed back from an upright position to a reclined position, as may be appreciated from FIGS. 2 and 3. The elastomeric straps are also preferably configured to hold the upper portion of the back 9 in that reclined position until a user manually pushes or manipulates the upper portion back to an upright position. For example, the elastomeric elements are preferably configured such that the flexing back of the upper portion 9 of the back frame does not cause the elastomeric straps to flex sufficiently for the straps to bias the upper portion 9 of the back frame to an upright position. Instead, the elastomeric straps are preferably configured to be sufficiently elastic such that reclining of the upper portion of the back sufficiently flexes the elastomeric straps so the straps hold or retain the position of the reclined upper portion 9 of the back frame.

Of course, it is contemplated that other variations of the present preferred embodiments of the chair may include elastomeric straps or another mechanism configured to bias the upper portion 9 of the back of the chair to the upright position when it is flexed back. Such a configuration would allow the upper portion of the back frame to not be maintained in a particular reclined position if a user did not constantly apply some force or weight to that upper portion of the back frame by resting his or her head on the back frame or leaning back against that portion of the back frame or otherwise providing such a force.

Referring to FIGS. 12-19, a second present preferred embodiment of the chair 51 includes a back frame 53 attached to a seat frame 54. The back frame 53 and seat frame 54 may be constructed similarly to the back frame and seat frame of the first present preferred embodiment of the chair discussed above. The back frame 53 and seat frame 54 are supported by a base 52. The base 52 includes a gas spring 56 that is attached to a stand or is attached to a pedestal. The stand or pedestal may include a stationary platform 55 or a platform that is connected to castors that permit the chair to be rolled to different locations.

The height of the chair 51 may be adjusted from a lower position to a higher position or from a higher position to a lower position by actuating the gas spring. The gas spring 54 may be attached to the seat frame 54 so that the seat frame 54 and back frame 53 are rotatable relative to the gas spring. For instance, a swivel post weldment 57 may be attached to the top portion of the gas spring to permit the seat frame 54 and back frame 53 to be rotated. The gas spring may also be attached to the seat frame 54 such that the seat frame 54 and back frame 53 can be tilted or rocked. For example, the swivel post weldment 57 may include a flexible joint that permits both rotation and tilting.

Figure 20:
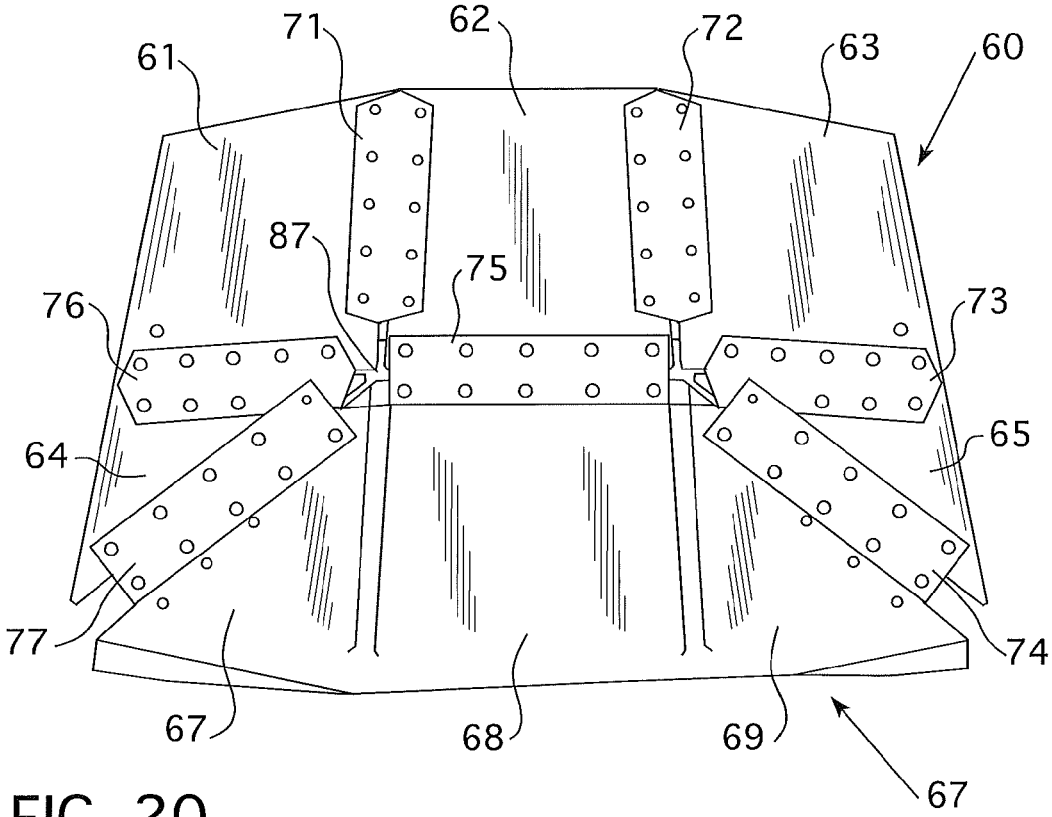
FIG. 20 is a front view of a first present preferred back frame that may be used in embodiments of the chair.
Figure 21:
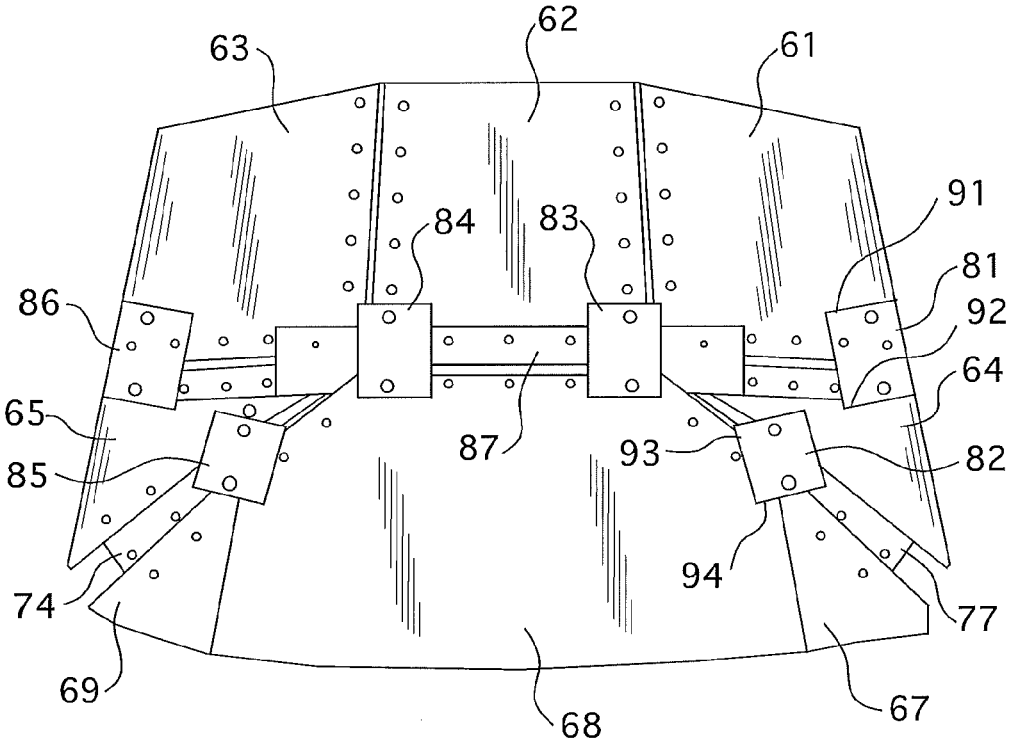
FIG. 21 is a back view of the first present preferred back frame that may be used in embodiments of the chair.

A present preferred back frame 61 is shown in FIGS. 20 and 21. The back frame 60 may be included in embodiments of the chair. The back frame includes an upper portion 61 that is comprised of multiple back frame supports 62, 63, 64, 65 and 66. The back frame supports 61, 62, 63, 64 and 65 are interconnected by a first set of elastomeric members 71, 72, 73, and 76 along the front surface of the back frame supports. The back frame supports 61, 62, 63, 64 and 65 are also connected to a lower portion 67 of the back frame by a second set of elastomeric members 74, 75 and 77 along the front surface of the back frame supports.

The back frame also has a lower portion 67 that is comprised of back frame supports 67, 68 and 69. The back frame supports 67, 68 and 69 are interconnected. For example, the back frame supports 67, 68 and 69 may be fastened together or integrally molded together. The back frame support 67 is attached to back frame support 64 via an elastomeric member 77 along the front surface of the supports. The back frame support 68 is attached to a back frame support 62 along the front surface of the supports. The back frame support 65 is attached to back frame support 69 by an elastomeric member 74 along the front surface of the back frame supports.

The back frame supports are also interconnected by a third set of elastomeric members 81, 82, 83, 84, 85, and 86 positioned along the rear surface of the back frame supports. Elastomeric member 81 is positioned to attach back frame support 61 to back frame support 64. Elastomeric member 82 is positioned to attach back frame support 64 to back frame support 67. Elastomeric members 83 and 84 are positioned to attach back frame support 62 to back frame support 68. Elastomeric member 85 is positioned to attach back frame support 65 to back frame support 69. Elastomeric member 86 is positioned to attach back frame support 65 to back frame support 63.

It should be appreciated that the elastomeric members 81-86 may be positioned to prevent or limit forward movement of the back frame supports. For example, the elastomeric members 81-86 may prevent the back support elements of the upper portion of the back frame from moving forward to an upright position.

A fourth set of elastomeric members, which only includes elastomeric member 87, is positioned between elastomeric members 84 and 83 and is attached to the rear surface of back supports 61, 62 and 63 and is also adjacent to the rear surface of back supports 64 and 65. The elastomeric member 87 may also be attached to the front surface of back support 68 or, alternatively, be positioned to engage a portion of the front surface of back support 68.

The first and second sets of elastomeric members are preferably elongated members that are positioned such that the longest sides of the members extend between the back supports each elongated member interconnects or attaches to, as may be appreciated from FIG. 20. The third set of elongated members is preferably positioned so that the longest sides of the members define the height of the members as may be appreciated from FIG. 21 and are positioned so that the upper and bottom portions of each member are attached to adjacent back supports. For instance, elastomeric member 81 includes an upper portion 91 attached to back support 61 and a bottom portion 92 attached to back support 64. As another example, elastomeric member 82 includes an upper portion 93 attached to back support 64 and a bottom portion 94 attached to back support 67.

The fourth set of elastomeric members, which only includes elastomeric member 87 in the above discussed embodiment of a present preferred back frame, preferably is positioned so that the longer sides of the member extend across all the back supports that the elastomeric member 87 is attached to. For example, elastomeric member 87 has one of its longest sides positioned adjacent to back supports 61, 62, and 63 and the other of its longest sides positioned adjacent to back support 68. The elastomeric member 87 is positioned such that it is transverse to elastomeric members 84 and 83.

The elastomeric members 81-87 and 71-77 may be configured to permit the different back support elements 61, 62, 63, 64 and 65 to be flexed relative to the other elements such that each back support element is independently flexible to different positions and also maintains the position to which the upper portion of the back frame is placed without the aid of any locking mechanism or locking device. Such functionality can permit the upper portion of the back frame to provide numerous different flexed back or reclined positions that can be defined by a user. In embodiments of the article of furniture that are configured to permit the elastomeric members to maintain the flexed back or reclined position, a user may adjust the configuration of the back frame to meet his or her seating needs or to provide an aesthetically pleasing appearance.

Testing was conducted of different possible upper and lower back frame constructions for interconnecting upper and lower back frame portions to permit an upper back frame portion to move relative to the lower back frame portion and also maintain a particular reclined or flexed position after a user had moved the upper back frame portion to such a position until the user again applied force to the upper back frame portion to readjust the position of the upper back frame portion. Testing found that a piano hinge arrangement interconnecting the upper and lower back portions was not a very effective or desirable alternative design. Such a hinge arrangement was found to put too much stress on upholstery that may cover the back frame. For example, a leather upholstery was found to stretch too much as a result of such manipulation and would result in a leather upholstery that had an undesirable aesthetic effect or would be damages and unacceptable to a consumer. Further, the force required to recline the upper portion of the back frame was found to be undesirably high relative to other back frame designs such as, for example, the back frame design discussed above.

Figure 22:
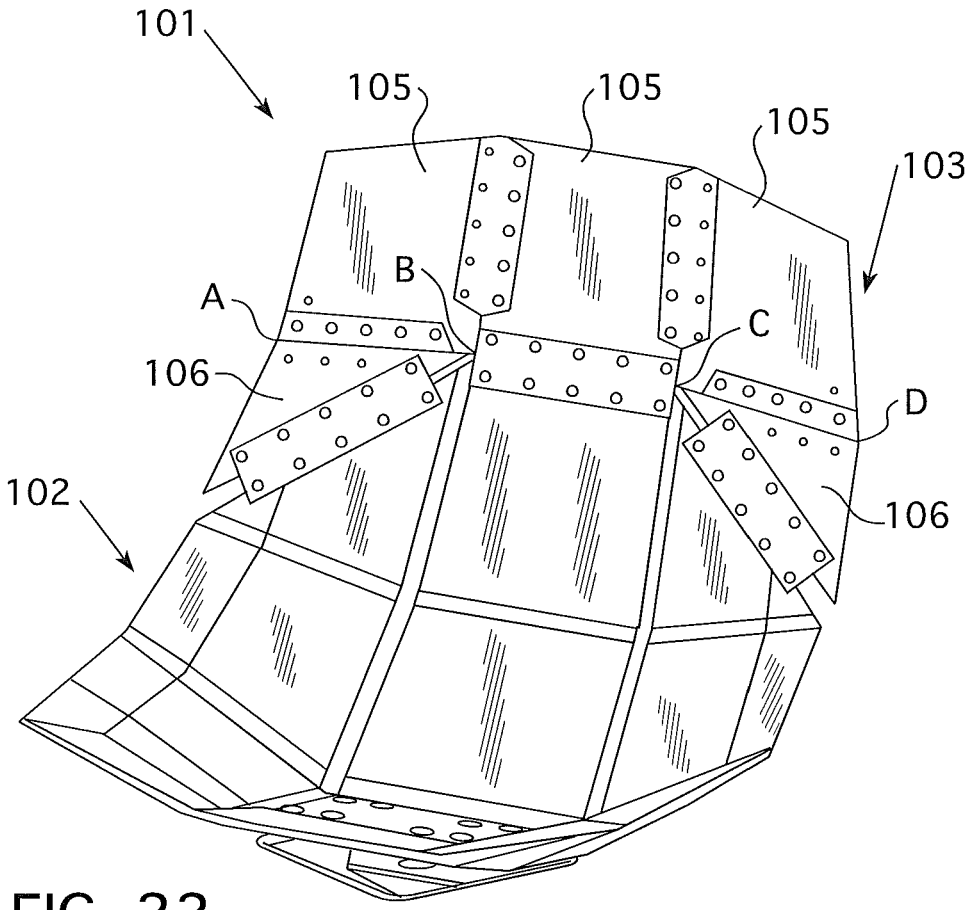
FIG. 22 is a perspective view of a present preferred seat frame connected to a present preferred back frame, which may be used in present preferred embodiments of a chair, such as a lounge chair.

Referring to FIG. 22, a present preferred frame arrangement 101 includes a seat frame 102 and a back frame 103 that are interconnected. The seat frame 102 is integrally molded with a lower portion of the back frame 102. The upper portion of the back frame includes a plurality of upper back support elements 105 that are generally polygonal in shape and a plurality of intermediate back support elements 106 that are also generally polygonal in shape. Preferably, the upper back support elements 105 are square or rectangular in shape and the intermediate back support elements 106 are triangular in shape.

At least one elastomeric member may extend from a left side of the back frame to a right side of the back frame. For example, an elongated elastomeric member similar to elastomeric member 87 discussed above may be positioned to extend between the point A and point D identified in FIG. 22. Other elastomeric members may be positioned to interconnect different upper or intermediate back support elements together as well such that each back support element may flex or move relative to other back support elements. The back frame 103 is sized and configured such that the upper portion of the back frame may recline or tilt relative to the lower portion of the back frame.

The elongated elastomeric member (not shown) may define a first recline axis about which the upper portion of the back frame may rotate or the upper back support elements 105 may move about that axis. The upper back support elements 105 are interconnected such that the outer edges identified at points A and D in FIG. 22 drop as the upper portion of the back frame reclines. For instance, points A and D identified in the back frame may be closer to the ground when the upper portion of the back frame is in a reclined position and may be farther from the ground when the upper portion of the back frame is in an upright position. In contrast, points B and C may not experience any drop in height when the back is reclined or may experience a drop in height that is less than the drop in height at points A and D when the back frame is in a reclined position.

It should be understood that variations of the present preferred embodiments of articles of furniture discussed above may be made. For example, a different number or arrangement of elastomeric members may be used for different back frame configurations. As another example, embodiments of the back frames discussed above may be sized and configured for use in sofas or other furniture such as love seats.

While certain present preferred embodiments of articles of furniture and methods of making such furniture have been shown and described above, it is to be distinctly understood that the invention is not limited thereto but may be otherwise variously embodied and practiced as may be appreciated by those skilled in the art.

What is claimed is:

1. An article of furniture comprising:

a base;

a seat frame attached to the base; and a back frame, the back frame comprising an upper portion moveably attached to a lower portion by at least one first elongated elastomeric member, the lower portion of the back frame being attached to the seat frame;

the upper portion of the back frame comprising a plurality of back support elements, each back support element connected to at least one other back support element by at least one second elongated elastomeric member; and wherein the upper portion of the back frame is configured to move from an upright position to a reclined position and wherein the at least one first elongated elastomeric member is configured to flex when the upper portion is moved to the reclined position, the upper back frame portion attached to the lower back frame portion such that the at least one first elongated elastomeric member does not bias the upper portion of the back frame to the upright position after the upper portion of the back frame has been moved to the reclined position;

wherein the at least one first elongated elastomeric member is comprised of a first elastomeric strap; and the first elastomeric strap having a first side and a second side opposite the first side, the first and second sides being the longest sides of the first elastomeric strap, the first side of the first elastomeric strap being positioned to abut a portion of a rear surface of the back support elements of the upper portion and the second side being positioned to abut a portion of a front surface of the lower portion of the back frame.

2. The article of furniture of claim 1 wherein the back frame has a front surface and a rear surface opposite the front surface and the at least one second elastomeric member is comprised of a plurality of second elastomeric members positioned on the front surface of the upper portion of the back frame, the rear surface of the back support elements being part of the rear surface of the back frame, and wherein the article of furniture comprises:

a plurality of third elastomeric members, each of the third elastomeric members positioned along the rear surface of the upper portion of the back frame, an upper end of each of the third elastomeric members attached to at least one of the back support elements along the rear surface of the back frame and a lower end of each of the third elastomeric members attached to the lower portion of the back frame along the rear surface of the back frame, the third elastomeric members limiting forward movement of the back frame elements of the upper portion of the back frame, each of the third elastomeric members being elongated such that longest opposing sides of the third elastomeric member define a height of the third elongated member extending from the upper end to the lower end; and wherein each of the second elastomeric members is elongated such that longest opposing sides of the second elastomeric member extend between the back support elements to which the second elastomeric member is connected, each of the second elastomeric members being connected between two of the back support elements such that one of the longest opposing sides is attached to a first one of the back support elements to which the second elastomeric member is attached along a length of that side and the other longest opposing side is attached to a second one of the back support elements to which the second elastomeric member is attached along a length of that side.

3. The article of furniture of claim 2 wherein the first elastomeric member is configured such that the upper portion of the back frame is moveable from the upright position to the reclined position upon a first force acting on the upper portion to move the upper portion and is also configured to maintain that position after the first force is removed until a second force is applied to the upper portion of the back frame to move the upper portion to the upright position.

4. The article of furniture of claim 3 wherein the first elastomeric member is configured to be flexed into a flexed position when the upper portion is moved to the reclined position and stay in the flexed position to maintain the upper portion of the back frame in that position.

5. The article of furniture of claim 2 also comprising upholstery attached to the seat frame and upholstery attached to the back frame.

6. The article of furniture of claim 2 wherein the back support elements are composed of a polymeric material.

7. The article of furniture of claim 2 wherein the first elastomeric member is composed of a thermoplastic polyester elastomer.

8. The article of furniture of claim 2 wherein the article of furniture is a chair or a lounge chair.

9. The article of furniture of claim 2 wherein the back frame is configured such that the upper portion of the back frame is maintained in the at least one reclined position without the use of a lock mechanism configured to lock a position of the upper portion of the back frame.

10. The article of furniture of claim 2 wherein the upper portion of the back frame is moveable relative to the lower portion of the back frame and the lower portion of the back frame is attached to the seat frame such that the lower portion of the back frame is not moveable relative to the seat frame.

11. The article of furniture of claim 1 wherein the at least one first elastomeric member is also comprised of a plurality of additional first elastomeric straps, each additional first elastomeric strap extending from a respective back support element of the upper portion of the back frame to a portion of the lower portion of the back frame.

12. The article of furniture of claim 11 wherein the back frame has a front surface and a rear surface and the at least one second elastomeric member is comprised of a plurality of second elastomeric straps that are positioned on the rear surface of the back frame.

13. The article of furniture of claim 12 wherein each first elastomeric strap has a length and is aligned such that the length of the first elastomeric strap is transverse to a length of at least one of the second elastomeric straps.

14. The article of furniture of claim 2 wherein the base is comprised of a plurality of legs attached to the seat frame or the base is comprised of a pedestal attached to the seat frame.

15. The article of furniture of claim 14 wherein the pedestal is comprised of a gas spring that is attached to the seat frame.

16. The article of furniture of claim 2 wherein the seat frame is attached to the base such that the seat frame is at least one of rotatable relative to the base and tiltable relative to the base.

* * * * *